United States Patent [19]

Byrne

[11] 4,424,736

[45] Jan. 10, 1984

[54] VEHICLE CREWMAN'S HOOD

[75] Inventor: Andrew T. Byrne, Waterloo, Belgium

[73] Assignee: FMC Corporation, Chicago, Ill.

[21] Appl. No.: 296,671

[22] Filed: Aug. 27, 1981

[51] Int. Cl.[3] ..... F41H 1/00; A62B 17/00

[52] U.S. Cl. ..... 89/36 D; 89/36 H; 89/36 K; 2/2.5

[58] Field of Search ..... 89/36 D, 36 H, 36 K, 89/36 L; 2/2.5, 2.1 A, 2, 6, 424

[56] References Cited

U.S. PATENT DOCUMENTS

| | | | |
|---|---|---|---|
| 1,082,214 | 12/1913 | Robinson | 89/36 D |
| 1,203,155 | 10/1916 | Strout | 2/424 X |
| 1,928,306 | 9/1933 | Brennan | 89/36 |
| 2,985,129 | 5/1961 | Kirkpatrick | 2/2 X |
| 3,098,233 | 7/1963 | Hoagland | 2/3 |
| 3,131,598 | 5/1964 | Bair | 89/36 |
| 3,139,622 | 7/1964 | Schueller | 2/2.1 A |
| 3,537,668 | 11/1970 | Kosmo | 2/2.1 A X |
| 3,636,564 | 1/1972 | Vykukal | 2/2.1 A |
| 3,744,055 | 7/1973 | Brendgord | 2/2 |
| 3,978,525 | 9/1976 | Bothwell | 2/424 |
| 4,302,848 | 12/1981 | Otsuka | 2/2 |

*Primary Examiner*—Donald P. Walsh
*Assistant Examiner*—Donald G. Kelly
*Attorney, Agent, or Firm*—A. J. Moore; H. M. Stanley; R. B. Megley

[57] ABSTRACT

The hatch of a military vehicle is hermetically fitted with a crewman's shelter formed of flexible material for receiving the upper portion of a crewman's body, including his head, shoulders and arms. The head-receiving portion has a vision plate and is connected to the crewman's head for rotation of the vision plate with his head. The shelter has gloved sleeves for receiving the crewman's arms and the entire shelter is collapsible inside the hatch when the hatch door is closed.

2 Claims, 6 Drawing Figures

FIG_1
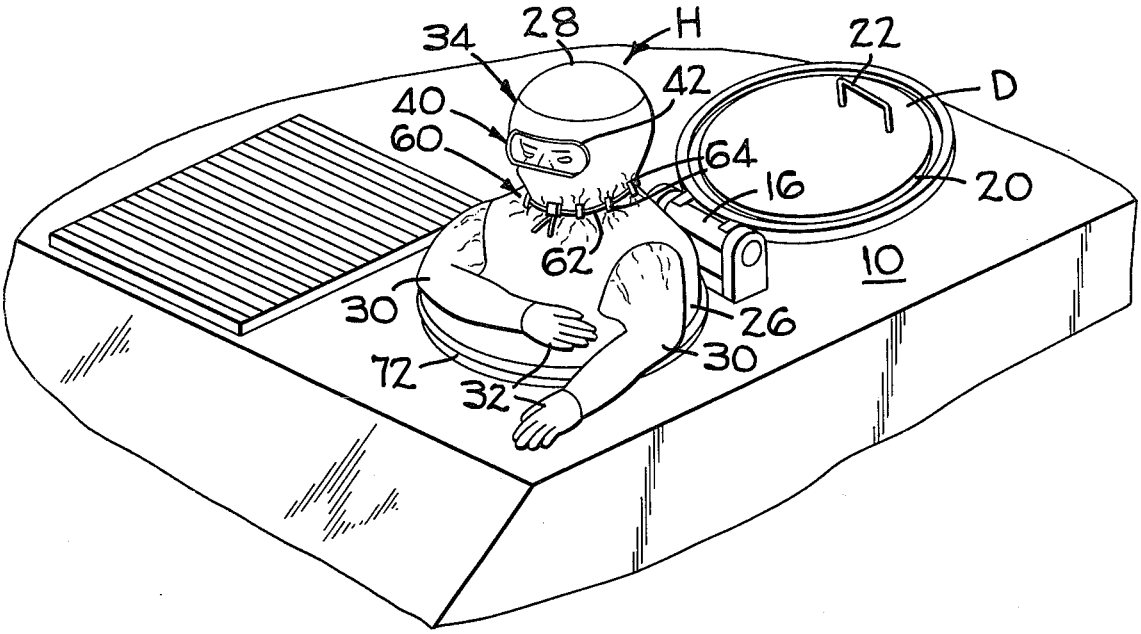
FIG_2
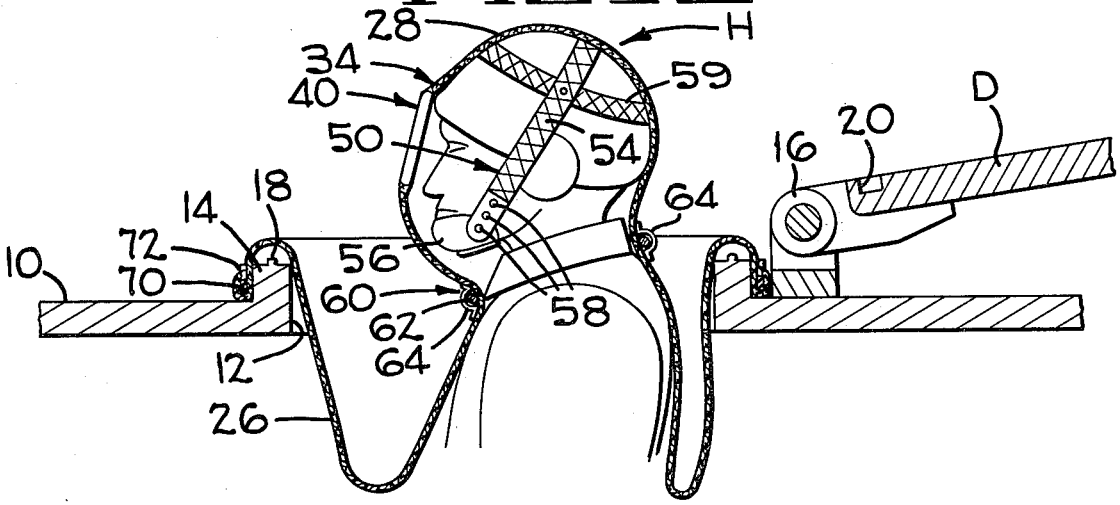
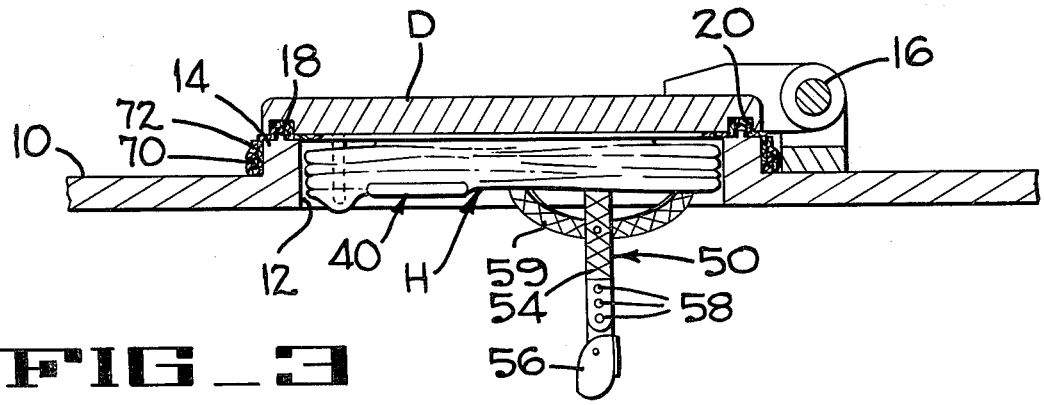
FIG_3

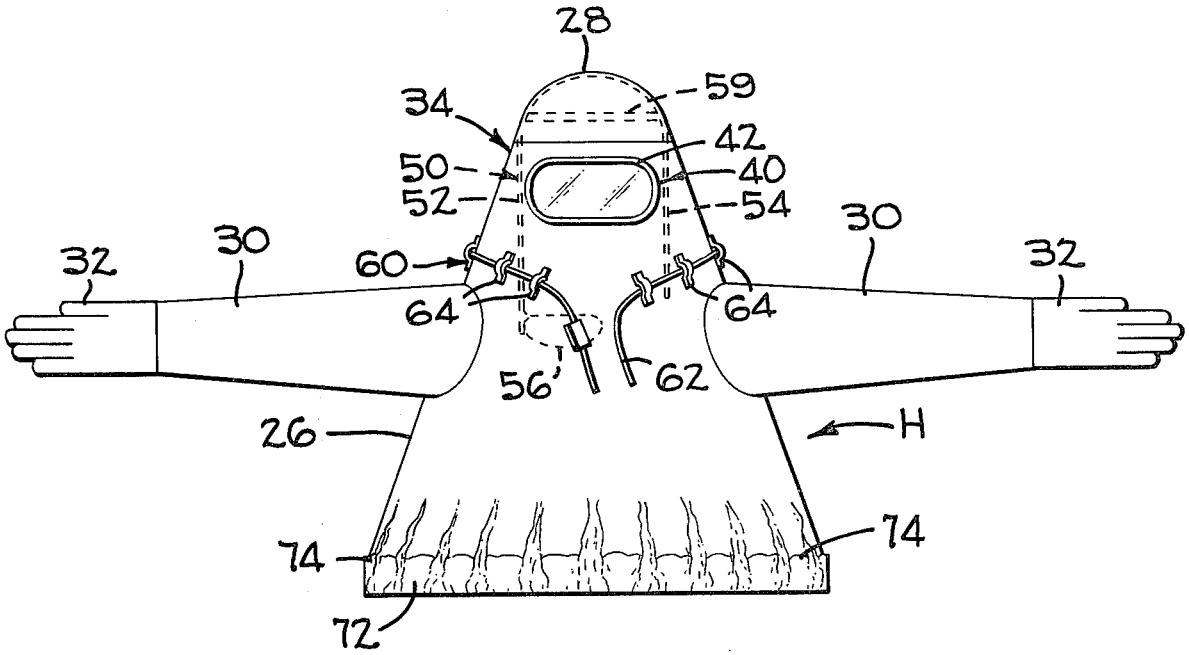
FIG_4
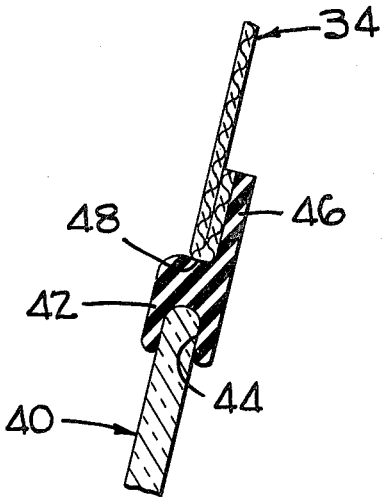
FIG_5
FIG_6
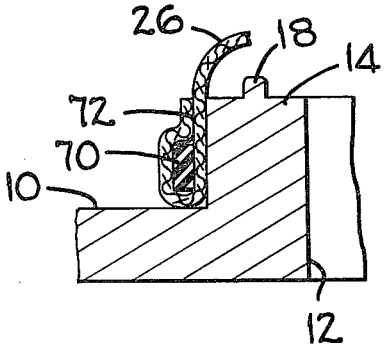

VEHICLE CREWMAN'S HOOD

FIELD OF THE INVENTION

This invention relates to a crewman's shelter for a vehicle and more particularly to a collapsible crewman's hood that is mounted around a hatch opening of a military vehicle.

BACKGROUND OF THE INVENTION

Armored military vehicles, such as tanks or the like are provided with a hatch opening closed by a hatch door in order that a crewman can open the hatch and partially rise through the opening for direct observation, weapon operation, etc. during maneuvers. However, when the hatch door is open, the vehicle interior is opened to inclement weather and vulnerable to poison gas and chemical attack. The present invention is a gas impermeable fabric, crewman's hood which accommodates the aforesaid direct observation by a crewman from an open hatch and seals off the hatch opening against inclement weather and chemical attack.

DESCRIPTION OF THE PRIOR ART

Bair U.S. Pat. No. 3,131,598, May 5, 1964 discloses an inflatable shelter or hatch cover for a military tank. A generally trapezoidal hatch opening is temporarily modified to provide a generally rectangular opening for mounting the cover, by the fitting of special deck plugs. The shelter is formed as a box-like structure having flexible side, back and roof panels and a rigid front windshield panel. The shelter is secured in the modified hatch opening by an inflatable attaching tube that is disposed entirely inside the hatch opening. The side and rear panels of the shelter are erected by inflatable side tubes and by a back tube, the tubes bearing against the deck outside of the hatch opening. Both the shelter and the deck plugs must be removed for closure of the hatch door.

Bothwell U.S. Pat. No. 3,978,525, Sept. 17, 1976 discloses a head and chest protector for motor cyclists. The protector is formed as a rigid outer shell having a head section formed as a part-spherical helmet-receiving cavity and mounting a vision visor. The helmet is connected by cords to an inertia reel which in turn is geared to a shock absorber.

Hoagland U.S. Pat. No. 3,098,233, July 23, 1963 discloses a shoulder-mounted safety hood designed to protect the wearer's head from splashing by caustic chemicals. A head hood having a 180° window and a depending flounce are mounted on a yoke band which supports the hood on the wearer's shoulders. The wearer rotates his head within and relative to the head hood and its 180° window.

Strout U.S. Pat. No. 1,203,155, Oct. 31, 1916 discloses a sting-proof bee veil. The veil includes a frusto-conical rigid head and neck protecting portion formed of open mesh wire screen enclosure which rests on the wearer's shoulders and rotates therewith. The upper end of the wire enclosure has a fabric extension with an elastic band which encircles and connects to the crown of the wearer's hat. A canvas shirt-like portion with sleeves depends from the lower end of the rigid wire screen enclosure.

SUMMARY OF THE INVENTION

The crewman's hood of the present invention embodies a number of improvements and features including the following:

- The hood can be mounted around a vehicle hatch opening without modification of the hatch opening and provides a hermetic, gas-tight seal with a hatch opening.
- The head-receiving portion of the hood mounts a front vision plate and rotates with the crewman's head.
- Preferably, the head receiving portion is attached to the crewman's head by chin straps.
- The hood is formed of flexible, gas-impervious sheet material and the entire hood is stowable within the hatch when the hatch is closed.
- The hood remains mounted in sealing relation with the hatch opening during stowage.
- The hood is preferably provided with glove-end sleeves for manipulation of the hood itself, operation of controls and weaponry and closing of the vehicle hatch door.

To summarize, in the preferred embodiment of the invention the hood is formed of a flexible, gas-impervious sheet material which is formed to provide a crewman's shoulder-receiving portion that is flexibly articulated to a head-receiving portion having a forward vision plate. Means are provided for connecting the head-receiving portion to a crewman's head and a hatch flange encircling band is mounted around the lower edge of the hood for gas-tight mounting of the hood around the hatch opening.

The manner in which the aforesaid improvements and features may be attained will be apparent to those skilled in the art from the following detailed description of a crewman's hood embodying the present invention.

BRIEF DESCRIPTION OF THE DRAWINGS

FIG. 1 is a perspective showing a crewman wearing the hood on a military vehicle.

FIG. 2 is a section through the hatch of the vehicle showing a crewman and a fitted, mounted hood.

FIG. 3 is a section like FIG. 2 showing the hatch door closed with the hood mounted in its collapsed, stowed position.

FIG. 4 shows the unmounted hood in its opened condition.

FIG. 5 is an enlarged fragmentary section illustrating the mounting of the vision plate.

FIG. 6 is an enlarged fragmentary section showing the elastic mounting band and hood seam.

DESCRIPTION OF THE PREFERRED EMBODIMENT

FIG. 1 discloses a vehicle such as a military tank, troop carrier or the like fitted with a hood embodying the present invention. The tank has an upper deck 10 formed with a generally circular hatch opening 12 (FIG. 3) which opening is surrounded by an upright flange 14. The hatch opening is closed by a hatch door D mounted on a deck hinge 16. As seen in FIG. 3, the flange 14 surrounding the hatch opening is formed with an upwardly projecting rib 18 that is received in a groove 20 formed in the hatch door D, when the latter is closed. The hatch door is provided with a handle 22 to facilitate closing of the hatch door.

In accordance with the present invention, a crewman's hood H is mounted on the vehicle in hermetic relation thereto at the hatch opening 12 and receives the head and shoulders of a crewman.

The hood H is formed of light weight, flexible, gas-impervious sheet material such as a vinyl coated square-woven nylon fabric, a rubberized fabric, or the like. The principal fabric criteria are flexibility, gas imperviousness and seam sewability or weldability. The hood is fabricated by using known and conventional seaming and aircraft or space suit fabrication techniques, the details which are not critical to the invention. In the embodiment shown (FIG. 4) the major portion of the hood is cut and seamed to form a frusto-conical major piece 26 that is joined or seamed to a cap piece 28 in a gas tight manner. Sleeves 30 have glove ends 32 hermetically attached to the sleeves. The sleeves 30 are hermetically attached to the major piece 26, as shown in FIGS. 1 and 4.

The upper portion of the major piece 26 and the cap piece 28 provide a crewman's head-receiving portion 34 of the hood. In order to provide forward vision for the crewman a transparent vision plate 40 is hermetically fitted to the head-receiving portion 34 of the hood. The vision plate is preferably formed of a curved sheet of plexiglass or the like and is mounted in the head-receiving portion 34, as shown in FIG. 5.

As seen in FIG. 5, the vision plate 40 is surrounded by a molded flexible channel member 42 formed of an elastomer, such as rubber or neoprene. Member 42 is formed with a channel 44 that receives the vision plate, the joint being cemented. The channel member 42 has an annular mounting flange 46 which is sewn and bonded within a seamed opening 48 formed in the head-receiving portion 34 of the hood. Vision plate 42 need only have dimensions large enough to accommodate normal forward vision of the crewman.

The vision plate 40 can be made relatively small in order to facilitate folding, collapse and stowing of the hood within the hatch opening 12, as seen in FIG. 3. Thus, to provide panoramic vision, the head-receiving portion 34 of the hood, along with the vision plate 40, are formed to move and rotate with the crewman's head. In the preferred embodiment, motion of the crewman's head is transmitted to the head-receiving portion 34 of the hood by means of a chin strap fitting indicated generally at 50. The details of the chin strap fitting are not critical to the invention so long as the fitting causes the vision plate 40 to follow motion of the crewman's head.

As seen in FIGS. 2 and 4, the chin strap fitting 50 includes depending reaches 52 and 54 having their upper ends secured to the cap piece 28 of the hood. Preferably, the reaches 52 and 54 are formed as a single strap. One of the strap reaches, such as reach 52, may terminate in a chin cup 56 which is adjustably mounted on that reach. The other reach 54 will terminate in a fastener, which may comprise one or more snap fasteners 58 (FIG. 3) for connection to a mating snap fastener on the chin cup 56. The chin strap assembly preferably includes a circumferential internal band 59 connected to the strap reaches 52 and 54 and bonded or otherwise attached to the head piece 34.

In order to facilitate rotary and nodding motion of the head piece 34 of the hood in response to corresponding motions of the crewman's head, the head piece 34 is preferably flexibly articulated to the lower body receiving portion of the hood. This flexible articulation is provided by forming a neck portion 60 (FIGS. 1 and 2) after a crewman has fitted himself within the hood with his arms and hands in the gloved sleeves 30. The neck portion 60 is then necked down by connecting the ends of a draw string 62 which passes through a ring of loops 64 secured to the hood fabric. Draw string 62 is manipulated by the crewman after he is within the hood. Quick-attachable fasteners, such as snaps or the like are fitted to the end portions of the draw strings or an adjustable, quick action bubble can be employed.

As mentioned, the hood H of the present invention can be semi-permanently mounted around the hatch opening 12 of the vehicle in a manner which seals off the opening against the weather and chemical attack. Referring to FIGS. 2, 3 and 6, an annular elastic band 70 surrounds the lower edge of the frusto-conical hood portion 26. The hood fabric is turned up at seam 72 (FIG. 6) to encompass and secure the elastic band 70. The seam 72 has a circumference that provides a tight fit and a hermetic seal with the deck flange 14. The aforesaid seal is augmented and maintained by contraction of the elastic band 70 confined with the seam 72. Thus, in its unmounted condition shown in FIG. 4, the lower edge of the hood will be slightly puckered at 74.

The hood H of the present invention can be collapsed and stowed within the hatch opening 12 and remains in place when the hatch door is closed. FIG. 3 illustrates the stowed condition of the hood schematically. The majority of the hood has been drawn into the hatch opening 12, leaving the lower seam 72 elastically mounted around the hatch flange 14. The hood fabric adjacent to seam 72 lays across the upper edge of the flange 14 and across the rib 18 and it is sealingly engaged by the inner face of the hatch door D when the latter is closed. An annular portion of the hood is trapped in the groove 20 of the hatch door by the rib 18 and the annular zones inside and outside of the rib are compressed between the hatch door surface and the outer surfaces of the rib 14. This provides a gas-tight seal of the hood with the hatch flange 14.

The hood, even in its stowed condition of FIG. 3, is always ready for extension through the hatch door and fitment to the head, shoulders and arms of a crewman, as previously described. The hatch door D can be opened by pushing up on the handle 22 on the inner face of the door through the flexible, collapsed material of the hood. A crewman can close the hatch door D as he withdraws into the hatch opening 12 by grasping the hatch door handle 22. If present, the neck portion draw string 60 is unfastened before the crewman withdraws his head, shoulders and arms from the hood. The chin strap fasteners 58 are released after the crewman has lowered himself through the hatch and has withdrawn his arms from the hood sleeves 30.

Having completed a detailed description of a preferred embodiment of the invention, it can be seen that I have provided a crewman's hood for the hatch of a military vehicle or the like that provides the features and advantages described in the opening summary of the invention.

I claim:

1. In combination, a mobile military vehicle having a body in which a crewman rides; means defining a flanged hatch opening in the upper portion of said vehicle body; a hatch door pivotally connected to said body for opening and closing said hatch opening; a handle on said door; and means defining a collapsible crewman's shelter of the type having means for mounting the shelter around the flanged hatch opening of the military vehicle; means in said shelter for receiving the upper portion of a crewman's body and a forward vision plate; said shelter being shaped as a hood; said hood being formed of flexible gas impervious sheet material, said material being formed to provide a crewman's shoulder, arm, hand and head receiving portions; said vision plate being in said head-receiving portion and means for connecting said head-receiving portion to a crewman's head for moving said head-receiving portion and the vision plate in response to movement of the crewman's head, said mounting means comprising a hatch flange encircling band around the lower edge of the shoulder-receiving portion of the hood for hermetically sealing the hood around the flange at the hatch opening; said hatch door being opened by the crewman while in said vehicle body by manually pushing a portion of the hood upwardly against the door to pivot said door open allowing the crewman to partially enter said crewman's shelter from inside of said vehicle body and partially extend the upper portion of his body when in said hood out of said hatch opening into the ambient atmosphere externally of the vehicle for observation or for manipulation of equipment externally of said vehicle body; said hatch being closed by the crewman gripping said handle with his hand while within said flexible gas impervious material of the hood with a major portion of the hood being collapsed within said hatch opening and a minor portion of said hood being compressed between said closed door and the upper surface of said hatch flange for providing a secondary hermetic seal in the event the seal around said flange should be damaged by gun fire or the like.

2. In a mobile vehicle having a crewman's cab with an upper deck having means defining a hatch opening and a hatch door for closing the hatch opening, the improvement comprising:

means defining a crewman's shelter hermetically sealed to said hatch opening when said hatch door is opened and when the shelter extends upwardly out of said opening for protecting the interior of the vehicle from a hostile environment; and also when said hatch door is closed with a major portion of said shelter collapsed within said crewman's cab and with a minor annular portion thereof being compressed between said closed door and upper deck for providing a secondary seal;

said shelter including a crewman's shoulder receiving portion, a crewman's head receiving portion with a vision plate therein, and a crewman's arm and hand receiving portion; and means for connecting said head receiving portion to the crewman's head for moving said head receiving portion and the vision plate in response to the movement of the crewman's head.

* * * * *